US012497875B2

(12) United States Patent
Duthie et al.

(10) Patent No.: US 12,497,875 B2
(45) Date of Patent: Dec. 16, 2025

(54) ARTIFICIAL LIFT APPARATUS WITH INTEGRATED SHUT-IN VALVE

(71) Applicant: Saudi Arabian Oil Company, Dhahran (SA)

(72) Inventors: Laurie S. Duthie, Ras Tanura (SA); Muhammad A. Harthi, Dhahran (SA); Omar Afif, Dhahran (SA); Faisal Alsubaie, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/541,681

(22) Filed: Dec. 15, 2023

(65) Prior Publication Data

US 2025/0198266 A1 Jun. 19, 2025

(51) Int. Cl.

| | |
|---|---|
| ***E21B 43/12*** | (2006.01) |
| ***E21B 17/02*** | (2006.01) |
| ***E21B 33/10*** | (2006.01) |
| ***E21B 34/06*** | (2006.01) |
| ***E21B 47/06*** | (2012.01) |

(52) U.S. Cl.

CPC ..... *E21B 43/128* (2013.01); *E21B 17/023* (2013.01); *E21B 33/10* (2013.01); *E21B 34/066* (2013.01); *E21B 47/06* (2013.01); *E21B 2200/06* (2020.05)

(58) Field of Classification Search

CPC ..... E21B 43/128; E21B 17/023; E21B 33/10; E21B 34/066; E21B 47/06; E21B 2200/06; E21B 34/08; E21B 2200/02

See application file for complete search history.

(56) References Cited

U.S. PATENT DOCUMENTS

| | | | |
|---|---|---|---|
| 4,798,247 | A | 1/1989 | Deaton et al. |
| 5,375,658 | A | 12/1994 | Shultz et al. |
| 6,041,857 | A | 3/2000 | Carmody et al. |
| 7,048,057 | B2 | 5/2006 | Bearden et al. |
| 8,536,731 | B2 | 9/2013 | Biester et al. |

(Continued)

FOREIGN PATENT DOCUMENTS

| | | |
|---|---|---|
| EP | 2356313 | 12/2014 |
| WO | WO 2021154310 | 8/2021 |

OTHER PUBLICATIONS

International Search Report and Written Opinion in International Appln. No. PCT/US2024/059316, mailed Mar. 26, 2025, 14 pages.

*Primary Examiner* — Nicole Coy
*Assistant Examiner* — Jennifer A Railey
(74) *Attorney, Agent, or Firm* — Fish & Richardson P.C.

(57) ABSTRACT

An artificial lift apparatus includes an ESP sub-assembly, shut-in valve (SIV) subassembly, and a pressure sensor, each operatively connected to a common electrical line. The ESP sub-assembly includes a pump and an ESP motor configured to receive electrical current from the common electrical line thereby drive the pump to pump fluids from the intake in an uphole direction through the production tubing string. The SIV sub-assembly includes a sliding sleeve connected to a linear actuator driven by an electric valve motor which receives electrical current from the common electrical line and drives the actuator translate the sliding sleeve to modulate fluid flow. The system is configured such that pressure data from the pressure sensor can be received at the surface via the common electrical line.

20 Claims, 7 Drawing Sheets

(56) References Cited

U.S. PATENT DOCUMENTS

| | | | | |
|---|---|---|---|---|
| 10,544,661 | B2 | 1/2020 | Noui-Mehidi et al. | |
| 10,677,032 | B1 | 6/2020 | Norton | |
| 11,021,939 | B2 | 6/2021 | Crowley et al. | |
| 2006/0157255 | A1 | 7/2006 | Smith | |
| 2014/0083684 | A1* | 3/2014 | Tips | E21B 43/14 166/205 |
| 2015/0330188 | A1* | 11/2015 | Moreno | E21B 34/14 166/305.1 |
| 2021/0246771 | A1* | 8/2021 | Ejim | E21B 43/128 |
| 2022/0381115 | A1* | 12/2022 | Simpson | E21B 34/12 |
| 2024/0360739 | A1* | 10/2024 | Fehri | E21B 34/14 |

* cited by examiner

ARTIFICIAL LIFT APPARATUS WITH INTEGRATED SHUT-IN VALVE

TECHNICAL FIELD

This disclosure relates to production of oil, gas, and other fluids from subterranean formations.

BACKGROUND

Electrical submersible pumps (ESPs) are artificial lift systems that utilize a downhole pumping system that is electrically driven, to increase production of fluids from a well.

SUMMARY

Certain aspects of the subject matter herein can be implemented as an artificial lift (AL) apparatus configured to be attached to a production tubing string downhole of a packer disposed on the production string, the production string disposed within a wellbore drilled from a surface location into a subterranean zone. The AL apparatus includes an electrical submersible pump (ESP) sub-assembly, a shut-in valve (SIV) sub-assembly at least partially enclosed within a cylindrical housing and integrally connected to a downhole end of the ESP sub-assembly, and a pressure sensor, wherein the AL apparatus is configured such that, when the assembly is disposed in the wellbore, the sensor is exposed to fluid pressure in an annular volume within the wellbore exterior of the SIV sub-assembly downhole of the packer. The ESP sub-assembly includes an intake at a downhole end of the ESP sub-assembly, a pump, and an ESP motor. The ESP motor is configured to drive the pump and thereby pump fluids from the intake in an uphole direction through the production tubing string. The SIV sub-assembly includes a sliding sleeve, a linear actuator connected to the sliding sleeve, and an electric valve motor. The electric valve motor is configured to drive the linear actuator to axially translate the sliding sleeve within the housing, thereby modulating a flow of fluid from the subterranean zone through one or more external ports of the SIV sub-assembly into the intake of the ESP sub-assembly. The AL apparatus is configured to be attached to the production string as integral unit and further includes an electrical line connected to the ESP motor and the electric valve motor and configured to convey electrical current transmitted from the surface location to the ESP motor and the electric valve motor.

Certain aspects of the subject matter herein can be implemented as a method. The method includes attaching a packer and an AL apparatus to a production tubing string configured to disposed within a wellbore drilled from a surface location drilled into a subterranean zone such that the packer is uphole of the AL apparatus. The AL apparatus includes an ESP sub-assembly including an intake at a downhole end of the ESP sub-assembly, a pump, and an ESP motor configured to drive the pump. The AL apparatus also includes an SIV sub-assembly at least partially enclosed within a cylindrical housing and integrally connected to a downhole end of the ESP sub-assembly. The SIV sub-assembly has one or more external ports and includes a sliding sleeve, a linear actuator connected to the sliding sleeve, and an electric valve motor operably attached to the linear actuator. The electric valve motor configured to drive the linear actuator to axially translate the sliding sleeve within the housing. The AL apparatus also includes a pressure sensor and an electrical line connected to the ESP motor and the electric valve motor. The electrical line is configured to convey electrical current transmitted from a surface location to the ESP motor and the electric valve motor. The method further includes disposing the production tubing string within the wellbore such that the SIV sub-assembly is proximate a production zone and the sensor is exposed to fluid pressure in an annular volume within the wellbore exterior of the SIV sub-assembly downhole of the packer. The method further includes actuating the packer so as to isolate the annular volume and transmitting electrical current via the electrical line to the ESP, thereby activating the ESP motor to drive the pump to initiate a flow of fluid from the subterranean zone through the one or more ports into the intake of the ESP sub-assembly and in an uphole direction through the production tubing string. The method further includes modulating a flow of fluid from the subterranean zone through one or more external ports of the SIV sub-assembly into the intake of the ESP sub-assembly by transmitting electrical current via the electrical line to the electric valve motor.

Certain aspects of the subject matter herein can be implemented as a system including a production string with a packer attached thereto and disposed within a wellbore drilled from a surface location into a subterranean zone and an AL apparatus attached as an integral unit to the production tubing string downhole of the packer. The AL apparatus includes an ESP sub-assembly, an SIV subassembly, and a pressure sensor, each operatively connected to a common electrical line. The ESP sub-assembly includes an intake at a downhole end of the ESP sub-assembly, a pump, and an ESP motor. The ESP motor is configured to receive electrical current from the common electrical line and configured to drive the pump and thereby pump fluids from the intake in an uphole direction through the production tubing string. The SIV sub-assembly is at least partially enclosed within a cylindrical housing and includes a sliding sleeve, a linear actuator connected to the sliding sleeve, and an electric valve motor. The electric valve motor is configured to receive electrical current from the common electrical line and drive the linear actuator to axially translate the sliding sleeve within the housing, thereby modulating a flow of fluid from the subterranean zone through one or more external ports of the SIV sub-assembly into the intake of the ESP sub-assembly. The pressure sensor is exposed to fluid pressure in an annular volume within the wellbore exterior of the SIV sub-assembly. The system is configured such that pressure data from the pressure sensor can be received at the surface via the common electrical line.

DETAILED DESCRIPTION

Figure 1:
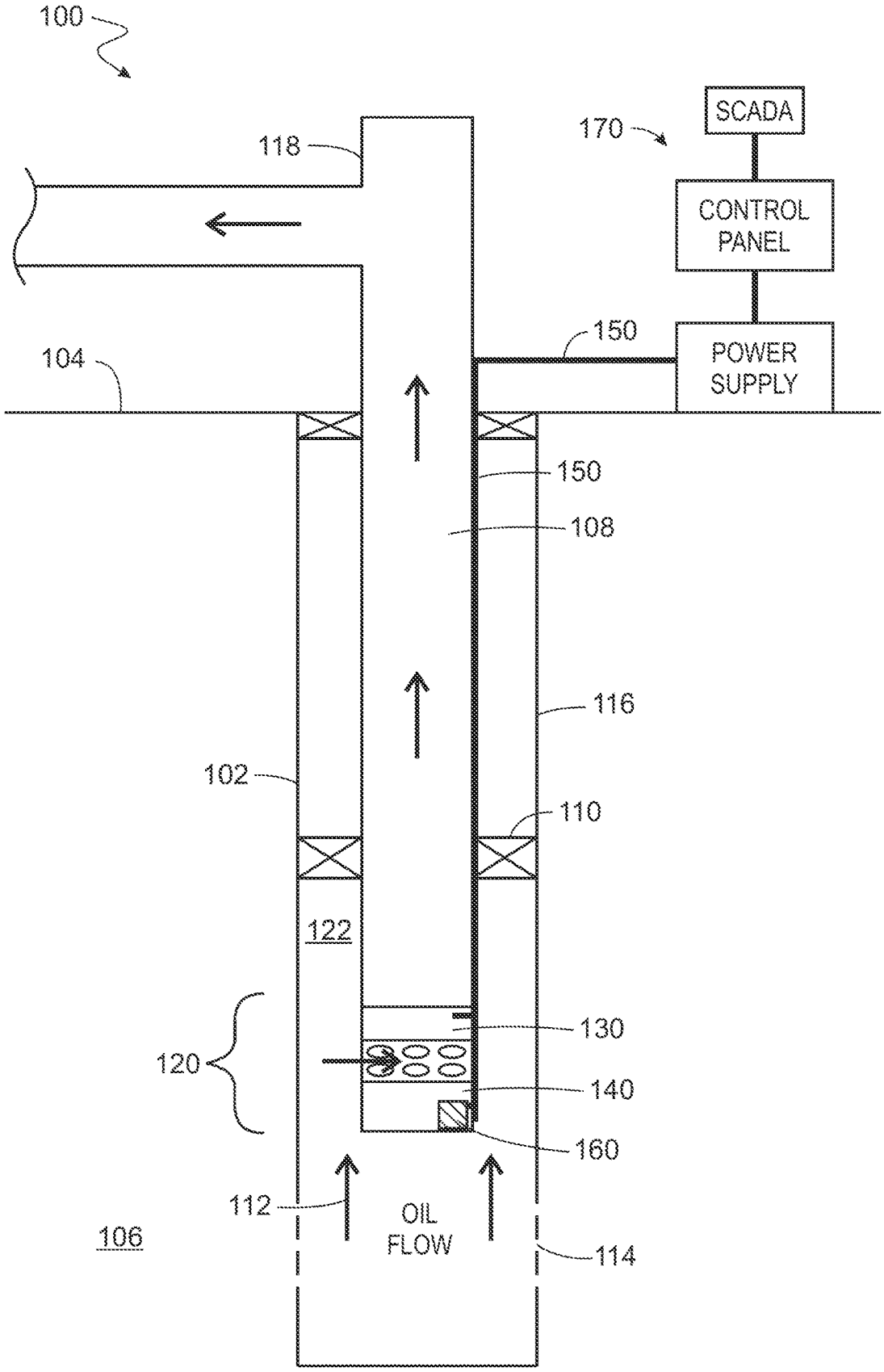
FIG. 1 is a schematic illustration of a well system including an artificial lift apparatus in accordance with embodiments of the present disclosure.

In some circumstances it can be desirable to shut off produced fluid flow downhole of a downhole artificial lift system such as an electric submersible pump. For example, a pressure survey can be an important source for dynamic reservoir data and can be used to establish certain reservoir characteristics such as any formation damage and other sources of skin effect. However, if well flow is shut off near the surface, the well can still continue to flow (so-called after flow) into the tubing volume, a phenomenon known as the wellbore storage effect. Wellbore storage can also mask critical flow regimes, when analyzing derivative plot features, reservoir characteristic responses can be misinterpreted leading to incorrect conclusions on formation damage, reservoir heterogeneity. This could have negative consequences in the efficient management of the reservoir, with incorrect key parameters obtained such as the skin and permeability. Because of this storage effect, deep-set valves can be preferable for pressure build up surveys.

Similarly, in some circumstances it can be desirable to partially reduce (i.e., partially choke) fluid flow to the artificial lift system. Such partial choking can be done for many reasons, including to control the flow rate of the well by adjusting the pressure drop as well conditions or objectives change, for controlling the relative production of water and gas, and/or for reducing or eliminating the production of hydrates. Such partial choking can also be useful for the reducing or eliminating the entrance of sand or other solids into an ESP for water/gas control, sand control (i.e., the reduction or elimination of the production of solids).

In some circumstances production can occur from multiple zones below an ESP. It can be desirable in such circumstances to individually and selectively choke production from one or more of such multiple zones.

Conventional permanent deep-set valves can be expensive and complicated as they may require dedicated hydraulic control lines. Similarly, temporary valves may require battery power any may not provide real-time control or data communication and may be difficult to surface, not synchronized with the submersible pump. Such conventional systems may also be difficult to synchronize with a submersible pump system.

In accordance with some embodiments of the present disclosure, an artificial lift apparatus is disclosed that is configured to be attached to a production tubing string. The assembly includes both and electrical submersible pump sub-assembly and an electrical shut-in valve sub-assembly. The assembly further includes a pressure sensor suitable for annular pressure surveys. A single electrical line running from the surface can be connected to the ESP motor, the electric valve motor, and the pressure sensor. The system of the present disclosure can provide an inexpensive way to produce higher quality data for pressure transient analysis by minimizing well bore storage effects, thus enabling an operator to better identify the radial flow regime, obtain reservoir permeability and skin, and to reduce the length of time a well needs to be shut in for. The volume of annular fluid and corresponding compressibility during a pressure build-up can be reduced, and this can be particularly advantageous for horizontal or fractured wells which already face larger wellbore storage effects. Minimizing wellbore storage will reduce the build-up period duration to acquire enough data for analysis. Depending on the actual reservoir characteristics, the reduction in time required to reach radial flow could be days or longer. This will allow the well to be returned to production reducing the well offline time to maximize production availability.

Because the artificial lift assembly is an integral unit, the length of the bottom hole assembly (BHA) can be reduced as compared to conventional systems, which can advantageous during the make-up of the BHA on the rig floor. In addition, the integrated shut-off valve can be utilized to isolate the pump equipment from the reservoir in situations in which the pump is shut down for extended periods, reducing the effects of corrosive elements such as $H_2S$ gas. In the event a well is temporarily mothballed, a corrosion inhibiting fluid can be bull headed (pumped) from surface into the apparatus with the valve partially or fully closed, to aid in preservation of the pump components.

The shut-in valve component of the apparatus can be used as an isolation barrier from the reservoir pressurized fluids and gas. This is useful for any well emergency, for well interventions with, for example, wireline or coiled tubing. For example, if the surface production tree is in need of replacement, the shut-in valve component of the apparatus, as a primary or back-up flow barrier.

In some embodiments, the shut-in valve component of the present disclosure can be utilized as part of a permanent downhole monitoring system (PDHMS) assembly, in addition to (or instead of) its deployment as part of an artificial lift system.

FIG. 1 is a schematic illustration of a well system including an artificial lift apparatus in accordance with embodiments of the present disclosure. Referring to FIG. 1, well system 100 includes a wellbore 102 drilled into a subterranean zone 106 from surface 104. Well system 100 can be an oil and/or gas well system, water well system, or other well system with a wellbore drilled into subterranean zone 106 for purposes of oil and/or gas production or other purposes or applications, and can be drilled from a surface (land) location or an offshore location. Wellbore 102 in the illustrated embodiment is substantially vertical; however, in some embodiments the wellbore can include both vertical and other-than-vertical (such as substantially horizontal) portions, and can comprise a single wellbore or can include multiple lateral wellbores. Well system 100 further includes a wellhead 118 which can include various spools, valves and adapters to provide pressure and flow control from wellbore 102.

In the illustrated embodiment, casing 116 has been installed and cemented in place within wellbore 102 to stabilize the wellbore, and a production tubing string 108 is installed within the casing. Produced fluid 112 (which can be, for example, oil, gas, or an oil-gas mixture) is produced from subterranean zone 106 via perforations 114 penetrating into the rock at a production zone within the subterranean zone 106, through tubing string 108. In the illustrated embodiment, a packer 110 isolates tubing-casing annulus (TCA) downhole of packer 110 from the TCA uphole of packer 110, forming an annular volume 122 defined by the interior surface of casing 116 and the exterior surfaces of tubing string 108 and the downhole assemblies attached to the tubing string 108 below packer 110.

In the illustrated embodiment, an artificial lift (AL) apparatus 120 is attached to a downhole end of tubing string 108 and is operable to draw oil or other fluids from subterranean zone 106 in an uphole direction through a central bore of tubing string 108. As described in greater detail below, artificial lift apparatus 120 includes an electric submersible pump (ESP) sub-assembly 130 and shut-in valve (SIV) sub-assembly 140. AL apparatus 120 can further include a high resolution pressure sensor 160 (which can be, for example a quartz pressure gauge or another suitable sensor) exposed to fluid pressure in annular volume 122. In addition to pressure sensor 160, AL apparatus 120 can further include temperature sensors, fluid density sensors, and/or fluid identity sensors. Surface control system 170 can include a surface control and monitoring panels, transformers, power supply, SCADA integration modules, and other suitable systems and modules monitoring or controlling system 100.

In the illustrated embodiment, surface control system 170 is communicatively connected to AL apparatus 120 via an electrical line 150 configured to convey electrical current to, and convey electronic signals (such as sensor data) to and from, AL apparatus 120. More specifically, in the illustrated embodiment, the single control line 150 provides power to, and communication to and from, ESP sub-assembly 130, SIV sub-assembly 140, sensor 160, and the other electrical components of AL apparatus 120. As only a single control line is used for the multiple components of AL apparatus 120, only one penetration (passageway) through packer 110 is required to provide the power and communication, thus reducing the likelihood of fluid leakage past or through packer 110. Control line 150 can consist of a single wire or can comprise an electrical cable comprising multiple electric wires and, in some embodiments, can further include optical fibers or other suitable components.

Figure 2A:
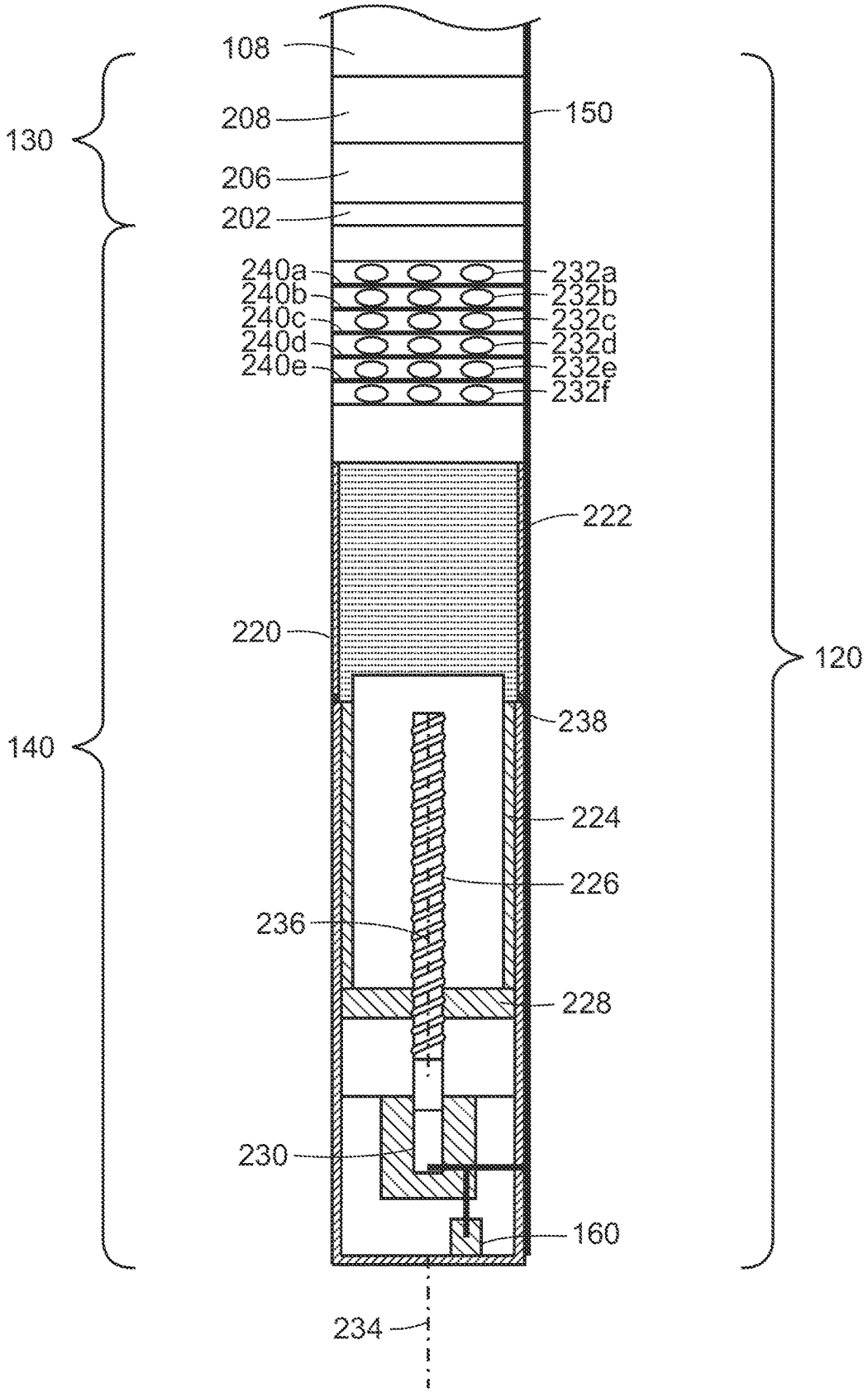
FIGS. 2A-2C are schematic illustrations of an artificial lift apparatus in accordance with embodiments of the present disclosure.
Figure 2B:
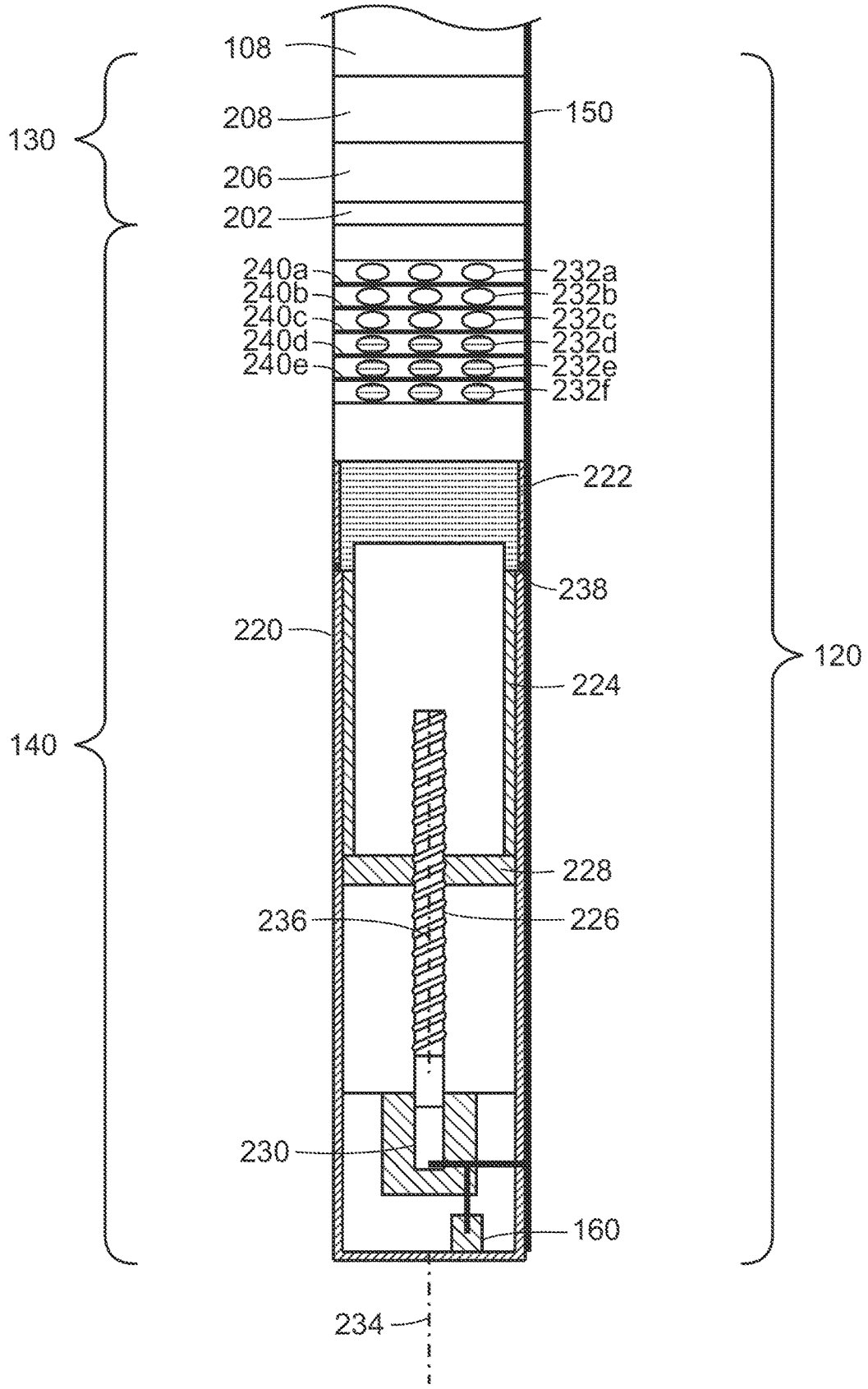
Figure 2C:
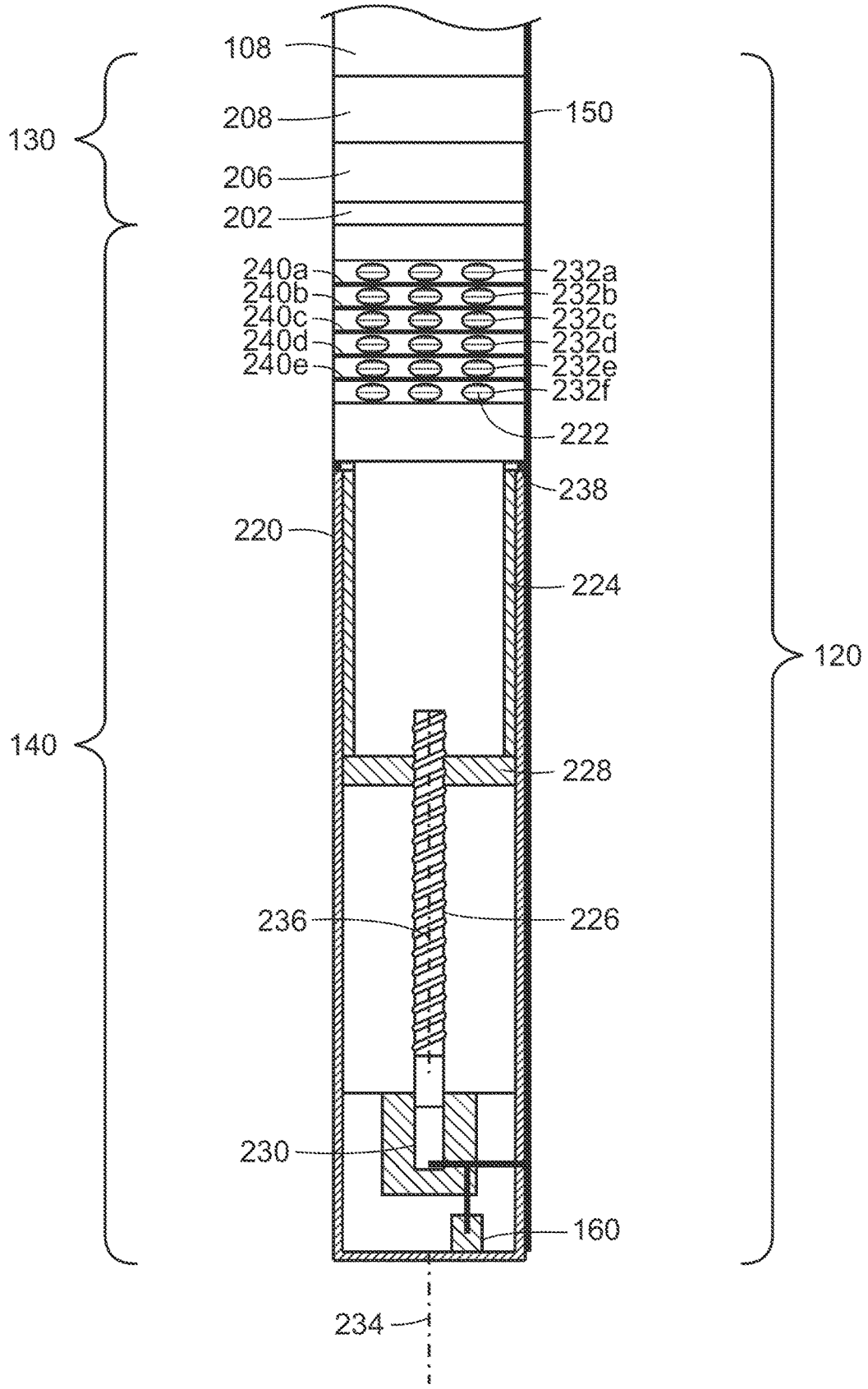

FIGS. 2A-2C are schematic illustrations showing AL apparatus 120 in greater detail, in accordance with embodiments of the present disclosure. Referring to FIG. 2A, as also described above in reference to FIG. 1, AL apparatus 120 is attached to a downhole end of tubing string 108 can includes ESP sub-assembly 130, SIV sub-assembly 140, and sensor 160. ESP sub-assembly 130 include an intake 202 at its downhole end 204, a pump 206, and an ESP motor 208 configured to drive the pump and thereby pump the produced fluids in an uphole direction through tubing string 108.

SIV valve sub-assembly 140 is attached to intake 202 of ESP sub-assembly 130 and includes a cylindrical, ported housing 220 into which sliding sleeve 222 is slidably disposed. Housing 220 includes a plurality of port rows 232*a*-232*f* penetrating through and arrayed axially along the housing. Linear actuator 224 includes a screw 226 connected via nut 228 to the sliding sleeve 222. In the illustrated embodiment, screw axis 236 of screw 226 is parallel to, and coincident with, central axis 234 of housing 220. Electric valve motor 230 can be a DC motor and is configured to rotate screw 226 (both clockwise and counterclockwise) and thereby axially translate sliding sleeve 222 within housing 220. That is, when screw 226 rotates in one direction, it drives sleeve 222 into the housing 220, progressively blocking the ports of port rows 232*a*-232*f* as it travels, thereby progressively reducing the flow of produced fluids that can flow into intake 202 of ESP sub-assembly 130, either partially or fully. Changing direction of screw 226 will reverse the action and pull the sleeve in the opposite direction towards a partially or fully open position. In the illustrated embodiment, internal seals 238 (which can be metal-to-metal seals, elastomeric seals, or other suitable seals) seal the interface between seal sliding sleeve 222 and housing 220, so as to reduce or eliminate leakage at the interface.

In the illustrated embodiments, because the plurality of port rows 232*a*-232*f* are arrayed axially along the length of the housing are separated from each other by isolation bands 240*a*-240*f*, the flow can be modulated between full flow (in the fully open position, shown in FIG. 2A, no flow (in the fully closed position, shown in FIG. 2C) and one or more intermediate flow states in which the sleeve is between the fully open and fully closed positions, as shown (for example) in FIG. 2B. In this way, the flow can be adjusted in increments as per requirements (for example in 10 or 20% increments) to allow flow from a range of 0% to 100%. Such choking could be utilized in, for example, permanent downhole monitoring systems (PDHMS) or smart well completions.

The rotation speed of the screw can be adjusted, enabling the speed of the closing or opening of the sleeve to be set as required. The rotations of the screw 226 have a linear response to the movement of the sleeve, a providing a feedback mechanism such that the operator using surface control system 170 can determine the position of the sliding sleeve. Motor 230 can be selected so as to provide adequate torque to deliver enough force to open and close the sliding sleeve. The control of the torque to the motor is regulated by the armature current delivered to the motor. In some embodiments, ESP motor 208 and valve motor 238 can be synchronized or otherwise controlled together in conjunction. For example, the system can be configured such that, when the command is given to shut off the well, ESP motor 208 will switch off first, immediately followed by the activation of valve motor 230 to close the sliding sleeve.

In the illustrated embodiment, AL apparatus 120, including ESP sub-assembly 130, SIV sub-assembly 140, and sensor 160, is configured as in integral unit and is attached as a single component of the production string prior to disposal of the production string downhole, with the common electrical line 150 as part of the integral unit and operatively connected to the subassemblies and sensor. Accordingly, in such embodiments, no production string segments or other components of the string separates the individual sub-assemblies of AL apparatus 120. In other embodiments, one or more of the sub-assemblies can comprise separate components attached to the production string (with, for example, one or more segments of production tubing therebetween). In some embodiments, in addition to the common electrical line, the apparatus can be connected to one or more additional electrical lines, and/or one or more non-electrical lines (such as fiber optic or hydraulic control lines), extending to the surface and operatively connected to these or other subassemblies and components of the AL apparatus.

Figure 3:
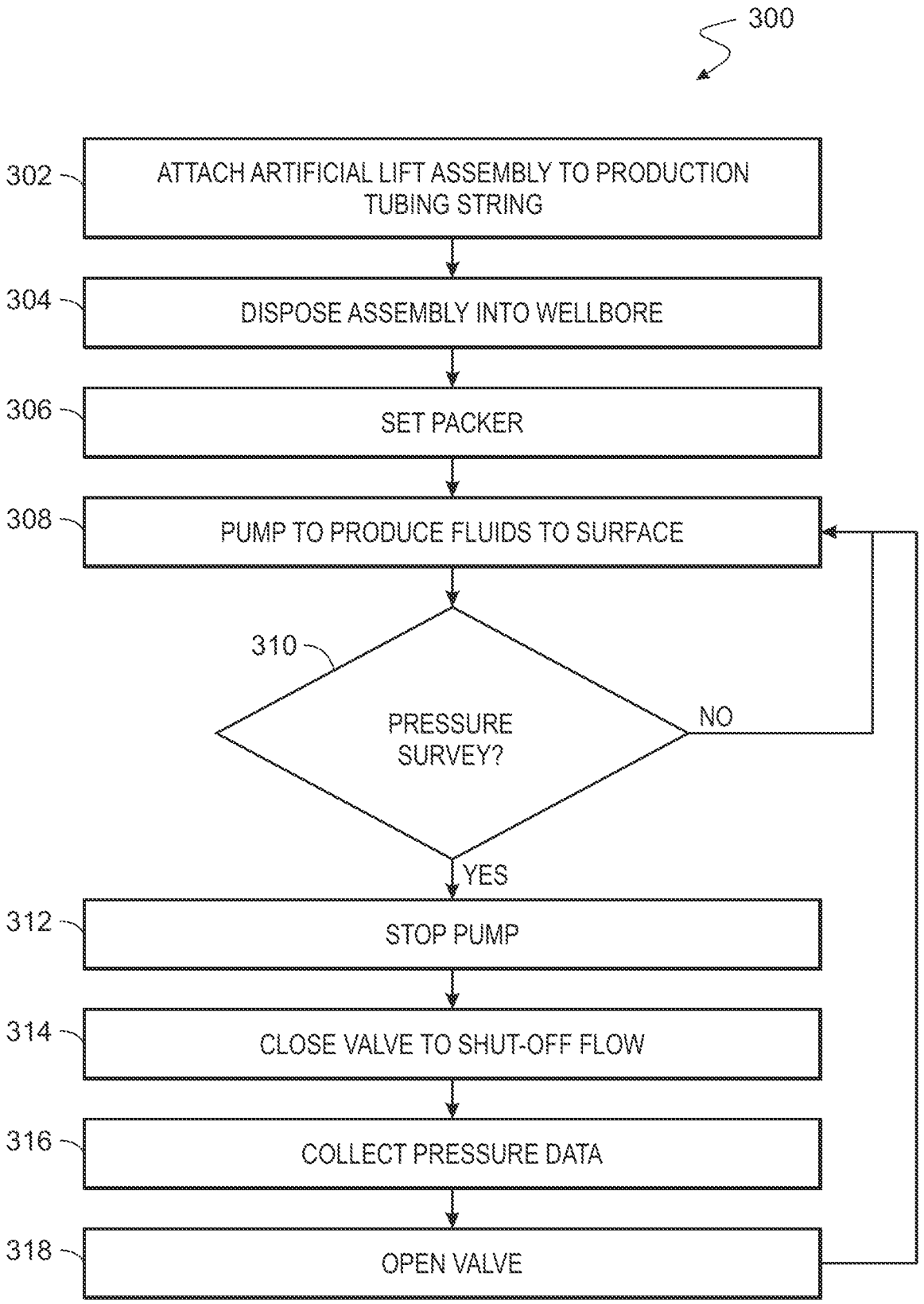
FIG. 3 is a process flow diagram of a method of operating an artificial apparatus in accordance with embodiments of the present disclosure.

FIG. 3 describes a method 300 of operating artificial lift apparatus 120 in connection with a pressure survey, in accordance with some embodiments of the present disclosure. Method 300 will be described herein by reference to the components of system 100 as described above in reference to FIGS. 1 and 2A and 2B; however, it will be understood that method 300 can be applied to other, similar systems with greater or fewer components.

Method 300 begins at step 302 in which the AL apparatus (for example, AL apparatus 120 of FIG. 1) is attached to the downhole end of tubing string and then proceeds to step 304 in which the tubing and assembly are disposed in the wellbore 102 such that the AL apparatus is proximate the production zone (perforations). At step 306, the packer can be actuated, thus isolating the annular volume below the packer that includes the AL apparatus.

Proceeding to step 308, electrical current is transmitted via the common electrical line to the ESP, thereby activating the ESP motor to drive the pump to initiate a flow of fluid from the subterranean zone through the one or more ports into the intake of the ESP sub-assembly and in an uphole direction through the production tubing string.

If at step 310 it becomes desirable to perform a pressure build-up survey, then the method proceeds to step 312 in which the electrical current transmission to the ESP is stopped. Proceeding then to step 314, the flow of fluid from the subterranean zone through the SIV sub-assembly into the intake of the ESP sub-assembly can be modulated (i.e., partially or fully stopped) by transmitting electrical current via the electrical line to the electric valve motor of the SIV sub-assembly, thus shifting the sleeve to a partially or fully closed position. At step 316, pressure data from the pressure sensor can be collected as part of the pressure build-up survey and conveyed via the electrical line. At step 318, upon completion of the pressure build-up survey, the valve can be re-opened and the method returns to the pump starting step of step 306.

The valve-closure design of AL apparatus 120 can also be used to isolate the reservoir from the surface in connection with several other applications. For example, the sliding sleeve valve can be utilized to provide well closure in the event of failure of a sub-surface safety valve (SSSV) or when well shut-in or choking is desired for well interventions (such as corrosion logs), pressure testing of the production tubing string, or when making well head repairs or replacements.

Figure 4:
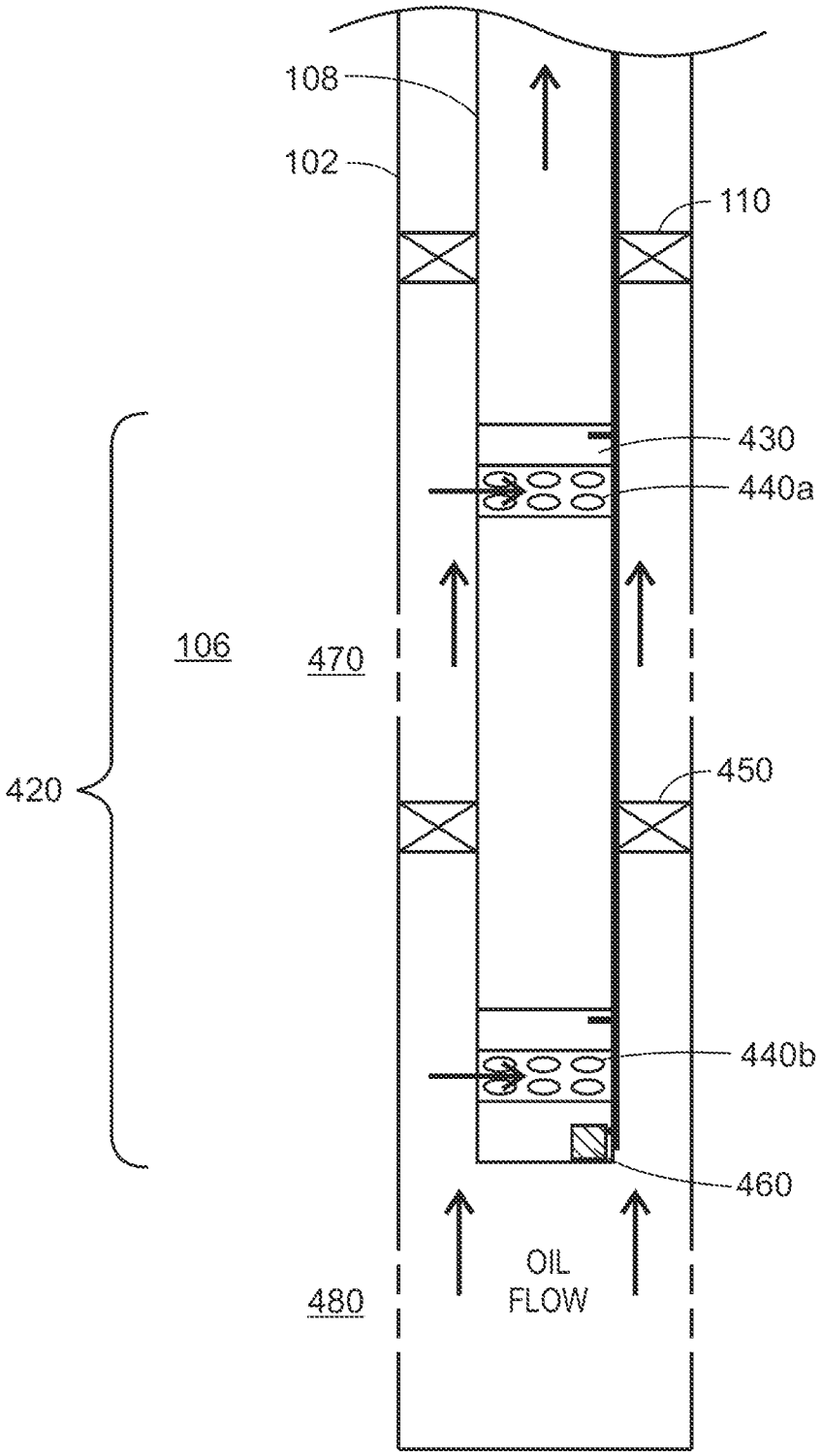
FIG. 4 is a schematic illustration of an artificial lift apparatus including a multi-zone valves in accordance with embodiments of the present disclosure.

FIG. 4 is a schematic illustration of an wellbore system including a multi-zone valves in accordance with embodiments of the present disclosure, in which an AL apparatus (shown as 420 in FIG. 4) is attached to the downhole end of tubing string 108, in a manner similar to AL apparatus 120 of FIGS. 1 and 2A-2C, likewise operable to draw oil or other fluids from subterranean zone 106 in an uphole direction through a central bore of tubing string 108. AL apparatus 420 includes an ESP sub-assembly 430 and pressure sensor 460, similar to ESP subassembly 130 and pressure sensor 160 of AL apparatus 120 of FIG. 1. In contrast to AL apparatus 120 of FIG. 1, AL apparatus 420 includes upper and lower SIV sub-assemblies 440*a* and 440*b*. In addition to packer 110 uphole of AL apparatus 420, an integral packer 450 separates upper and lower SIV sub-assemblies 440*a* and 440*b*. Thus, the system is configured such that the second packer can isolate an upper production zone 470 proximate the upper SIV sub-assembly 140*a* from a lower production zone 480 proximate the second SIV sub-assembly. In some embodiments (for example, for subterranean zones including three or four or more production zones), the AL apparatus can include a greater number (for example, three or four or more) additional SIV subassemblies (with corresponding additional intervening packers) to selectively isolate each of the respective productions zones. In this way, production from the different production zones can be choked separately and individually by controlling the valves of the individual SIV sub-assemblies. In the illustrated embodiment, packer 450 is in integral component of the AL apparatus. In some embodiments, packer 450 can be a component of the system separate from (not integral with) the AL apparatus.

Figure 5:
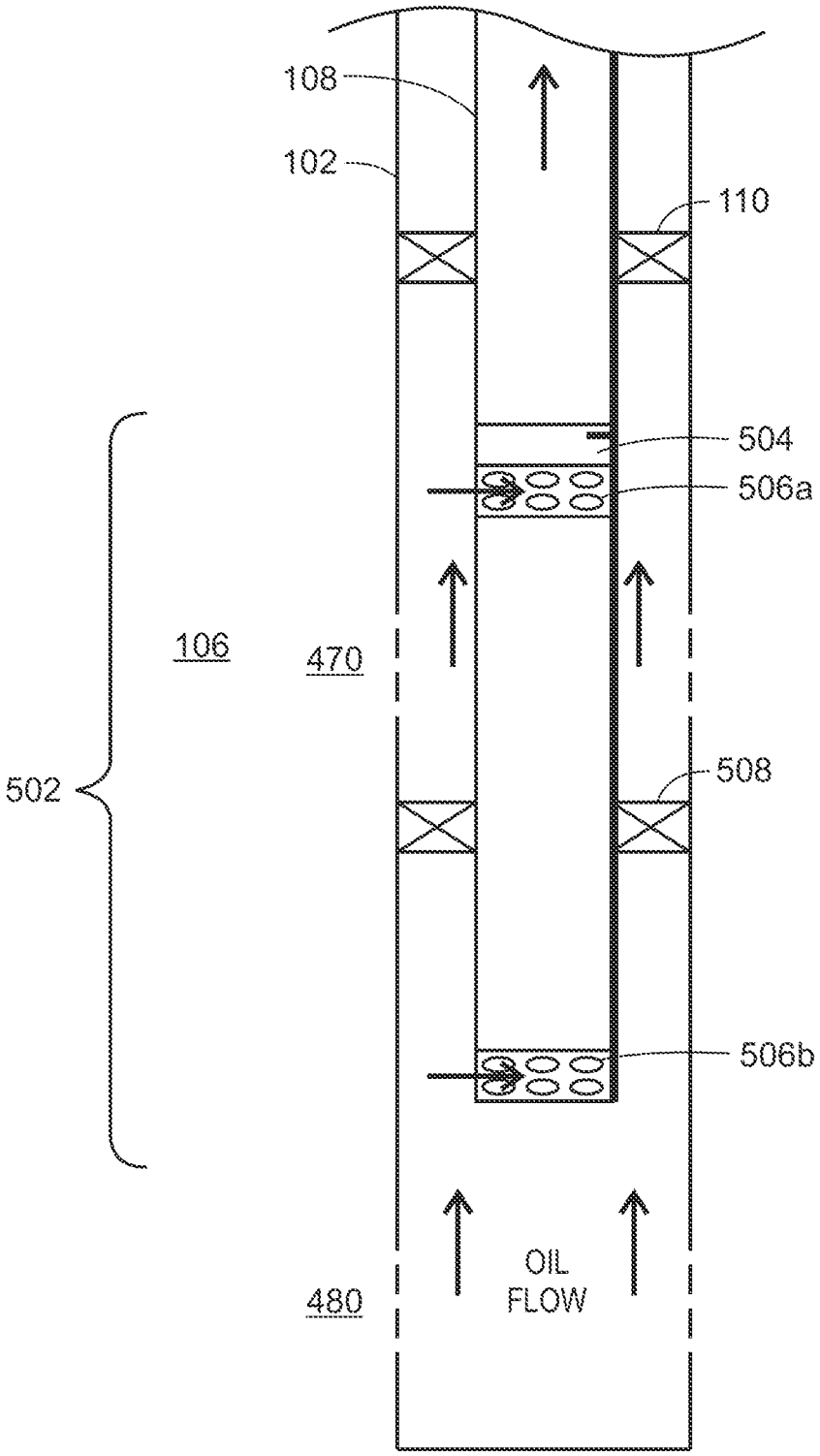
FIG. 5 is a schematic illustration of a permanent downhole monitoring system including sliding-sleeve valves in accordance with embodiments of the present disclosure.

FIG. 5 is a schematic illustration of an apparatus in accordance with embodiments of the present disclosure, in which SIV subassemblies 506*a* and 506*b* are similar or identical to SIV sub-assembly 140 of FIGS. 1 and 2A-2C are included as components of an integral permanent downhole monitoring system (PDMS) apparatus 502 that also includes monitoring and sensing module 504, wherein the sliding sleeves can be separately controlled by an electrical line and used as downhole choke to control the well flow in connection with such monitoring system. PDMS apparatus 502 is attached to the downhole end of tubing string 108, in a manner similar to AL apparatus 120 of FIGS. 1 and 2A-2C, such that oil or other fluids from subterranean zone 106 can flow in an uphole direction through a central bore of tubing string 108. Similar to the system shown in FIG. 4, In addition to packer 110 uphole of PDMS apparatus 502, an integral packer 508 separates upper and lower SIV sub-assemblies 506*a* and 506*b*. In this way, production from the different production zones can be choked separately and individually by controlling the valves of the upper and lower SIV sub-assemblies in connection with the permanent sensing and monitoring system.

In this disclosure, "approximately" or "substantially" means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

The term "uphole" as used herein means in the direction along a wellbore from its distal end towards the surface, and "downhole" as used herein means the direction along a wellbore from the surface towards its distal end. A downhole location means a location along a wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In a first aspect, an artificial lift (AL) apparatus is configured to be attached to a production tubing string downhole of a packer disposed on the production string, the production string disposed within a wellbore drilled from a surface location into a subterranean zone. The AL apparatus includes an electrical submersible pump (ESP) sub-assembly, a shut-in valve (SIV) sub-assembly at least partially enclosed within a cylindrical housing and integrally connected to a downhole end of the ESP sub-assembly, and a pressure sensor, wherein the AL apparatus is configured such that, when the assembly is disposed in the wellbore, the sensor is exposed to fluid pressure in an annular volume within the wellbore exterior of the SIV sub-assembly downhole of the packer. The ESP sub-assembly includes an intake at a downhole end of the ESP sub-assembly, a pump, and an ESP motor. The ESP motor is configured to drive the pump and thereby pump fluids from the intake in an uphole direction through the production tubing string. The SIV sub-assembly includes a sliding sleeve, a linear actuator connected to the sliding sleeve, and an electric valve motor. The electric valve motor is configured to drive the linear actuator to axially translate the sliding sleeve within the housing, thereby modulating a flow of fluid from the subterranean zone through one or more external ports of the SIV sub-assembly into the intake of the ESP sub-assembly. The AL apparatus is configured to be attached to the production string as integral unit and further includes an electrical line connected to the ESP motor and the electric valve motor and configured to convey electrical current transmitted from the surface location to the ESP motor and the electric valve motor.

In a second aspect in accordance with the first aspect, the electrical line is attached to the pressure sensor and is further configured to convey an electrical signal from the pressure sensor to the surface location.

In a third aspect in accordance with the first or the second aspect, the electric control line is disposed through one penetration extending through a packing element of the packer.

In a fourth aspect in accordance with any of the first to third aspects, the one or more external ports of the SIV sub-assembly comprise a plurality of external ports penetrating through and arrayed axially along the housing, and the modulating is by the axial translation of the sliding sleeve blocking fluid flow through one or more of a plurality of external ports.

In a fifth aspect in accordance with any of the first to fourth aspects, the modulating comprises blocking a subset of the plurality of ports by the sliding sleeve to modulate flow to a specified flow rate.

In a sixth aspect in accordance with any of the first to fifth aspects, the linear actuator comprises a screw having a screw axis, the screw attached to a nut attached to the sliding sleeve. The screw axis of the screw is parallel to, and coincident with, a central axis of the housing.

In a seventh aspect in accordance with any of the first to sixth aspects, the electrical line comprises an electrical cable comprising multiple electrical wires.

In an eighth aspect in accordance any of the first to seventh aspects, the packer is disposed on the production string is a first packer and the SIV sub-assembly is a first SIV sub-assembly, and the apparatus further includes a second packer and a second SIV subassembly integrally connected to a downhole end of the first SIV sub-assembly such that the first SIV sub-assembly is uphole of the second packer and the second SIV sub-assembly is downhole of the second packer.

In a ninth aspect in accordance any of the first to the eighth aspects, the apparatus is configured such that the second packer can isolate an upper production zone proximate the first SIV sub-assembly from a lower production zone proximate the second SIV sub-assembly.

In a tenth aspect, a method includes attaching a packer and an AL apparatus to a production tubing string configured to disposed within a wellbore drilled from a surface location drilled into a subterranean zone such that the packer is uphole of the AL apparatus. The AL apparatus includes an ESP sub-assembly including an intake at a downhole end of the ESP sub-assembly, a pump, and an ESP motor configured to drive the pump. The AL apparatus also includes an SIV sub-assembly at least partially enclosed within a cylindrical housing and integrally connected to a downhole end of the ESP sub-assembly. The SIV sub-assembly has one or more external ports and includes a sliding sleeve, a linear actuator connected to the sliding sleeve, and an electric valve motor operably attached to the linear actuator. The electric valve motor configured to drive the linear actuator to axially translate the sliding sleeve within the housing. The AL apparatus also includes a pressure sensor and an electrical line connected to the ESP motor and the electric valve motor. The electrical line is configured to convey electrical current transmitted from a surface location to the ESP motor and the electric valve motor. The method further includes disposing the production tubing string within the wellbore such that the SIV sub-assembly is proximate a production zone and the sensor is exposed to fluid pressure in an annular volume within the wellbore exterior of the SIV sub-assembly downhole of the packer. The method further includes actuating the packer so as to isolate the annular volume and transmitting electrical current via the electrical line to the ESP, thereby activating the ESP motor to drive the pump to initiate a flow of fluid from the subterranean zone through the one or more ports into the intake of the ESP sub-assembly and in an uphole direction through the production tubing string. The method further includes modulating a flow of fluid from the subterranean zone through one or more external ports of the SIV sub-assembly into the intake of the ESP sub-assembly by transmitting electrical current via the electrical line to the electric valve motor.

In an eleventh aspect in accordance with the tenth aspect, the method further includes receiving via the electric control line a signal comprising pressure sensor data from the pressure sensor.

In a twelfth aspect in accordance with the tenth or the eleventh aspect, attaching the AL apparatus to the production tubing includes attaching the AL apparatus to the production tubing as an integral unit.

In a thirteenth aspect in accordance with any of the tenth to the twelfth aspect, the electric control line is disposed through one penetration extending through a packing element of the packer.

In a fourteenth aspect in accordance with any of the tenth to the twelfth aspect, the one or more external ports of the SIV sub-assembly include a plurality of external ports penetrating through and arrayed axially along the housing, and the modulating is by the axial translation of the sliding sleeve blocking fluid flow through one or more of a plurality of external ports.

In a fifteenth aspect in accordance with any of the tenth to the twelfth aspect, the modulating includes blocking a subset of the plurality of ports by the sliding sleeve to modulate flow to a specified flow rate.

In a sixteenth aspect in accordance with any of the tenth to the twelfth aspect, the linear actuator includes a screw having a screw axis, the screw attached to a nut attached to the sliding sleeve. The screw axis of the screw is parallel to, and coincident with, a central axis of the housing.

In a seventeenth aspect, a system includes a production string with a packer attached thereto and disposed within a wellbore drilled from a surface location into a subterranean zone and an AL apparatus attached as an integral unit to the production tubing string downhole of the packer. The AL apparatus includes an ESP sub-assembly, an SIV subassembly, and a pressure sensor, each operatively connected to a common electrical line. The ESP sub-assembly includes an intake at a downhole end of the ESP sub-assembly, a pump, and an ESP motor. The ESP motor is configured to receive electrical current from the common electrical line and configured to drive the pump and thereby pump fluids from the intake in an uphole direction through the production tubing string. The SIV sub-assembly is at least partially enclosed within a cylindrical housing and includes a sliding sleeve, a linear actuator connected to the sliding sleeve, and an electric valve motor. The electric valve motor is configured to receive electrical current from the common electrical line and drive the linear actuator to axially translate the sliding sleeve within the housing, thereby modulating a flow of fluid from the subterranean zone through one or more external ports of the SIV sub-assembly into the intake of the ESP sub-assembly. The pressure sensor is exposed to fluid pressure in an annular volume within the wellbore exterior of the SIV sub-assembly. The system is configured such that pressure data from the pressure sensor can be received at the surface via the common electrical line.

In an eighteenth aspect in accordance with the seventeenth aspect, the one or more external ports of the SIV sub-assembly including a plurality of external ports penetrating through and arrayed axially along the housing, and the modulating includes modulating the flow of fluid comprises modulating the flow of fluid to a specified flow rate by axially translating the sliding sleeve to block a subset of the plurality of external ports.

In a nineteenth aspect in accordance with the seventeenth or eighteenth aspect, the linear actuator comprises a screw having a screw axis, the screw attached to a nut attached to the sliding sleeve, and the screw axis of the screw is parallel to, and coincident with, a central axis of the housing.

In a twentieth aspect in accordance with any of the seventeenth to nineteenth aspects, the packer disposed on the production string is a first packer and the SIV sub-assembly is a first SIV sub-assembly, and the AL apparatus further includes a second packer and a second SIV subassembly integrally connected to a downhole end of the first SIV sub-assembly such that the first SIV sub-assembly is uphole of the second packer and the second SIV sub-assembly is downhole of the second packer.

What is claimed is:

1. An artificial lift (AL) apparatus configured to be attached to a production tubing string downhole of a packer disposed on the production string, the production string disposed within a wellbore drilled from a surface location into a subterranean zone, the AL apparatus comprising:

an electrical submersible pump (ESP) sub-assembly comprising:

an intake at a downhole end of the ESP sub-assembly:

a pump;

an ESP motor, the ESP motor configured to drive the pump and thereby pump fluids from the intake in an uphole direction through the production tubing string;

a shut-in valve (SIV) sub-assembly at least partially enclosed within a cylindrical housing and integrally connected to a downhole end of the ESP sub-assembly, the SIV sub-assembly comprising:

a sliding sleeve;

a linear actuator connected to the sliding sleeve;

an electric valve motor, the electric valve motor configured to drive the linear actuator to axially translate the sliding sleeve within the cylindrical housing, thereby modulating a flow of fluid from the subterranean zone through one or more external ports of the SIV sub-assembly into the intake of the ESP sub-assembly; and a pressure sensor, wherein the AL apparatus is configured such that, when the assembly is disposed in the wellbore, the sensor is exposed to fluid pressure in an annular volume within the wellbore exterior of the SIV sub-assembly downhole of the packer; and one or more electrical lines, wherein at least one of the one or more electrical lines extends from the surface location through the packer to the AL apparatus as an electrical line common to both the ESP motor and the electric valve to convey electrical current transmitted from the surface location to both the ESP motor and the electric valve, wherein the AL apparatus is configured to be attached to the production string as integral unit.

2. The AL apparatus of claim 1, wherein the electrical line common to both the ESP motor and the electric valve is further connected to the pressure sensor to thereby convey an electrical signal from the pressure sensor to the surface location.

3. The AL apparatus of claim 1, wherein the electrical line common to both the ESP motor and the electric valve is disposed through one penetration extending through a packing element of the packer.

4. The AL apparatus of claim 1, wherein the one or more external ports of the SIV sub-assembly comprise a plurality of external ports penetrating through and arrayed axially along the cylindrical housing, and the modulating is by the axial translation of the sliding sleeve blocking fluid flow through one or more of a plurality of external ports.

5. The AL apparatus of claim 4, wherein the modulating comprises blocking a subset of the plurality of external ports by the sliding sleeve to modulate flow to a specified flow rate.

6. The AL apparatus of claim 1, wherein:

the linear actuator comprises a screw having a screw axis, the screw attached to a nut attached to the sliding sleeve; and the screw axis of the screw is parallel to, and coincident with, a central axis of the cylindrical housing.

7. The AL apparatus of claim 1, wherein the electrical line common to both the ESP motor and the electric valve comprises an electrical cable comprising multiple electrical wires.

8. The AL apparatus of claim 1, wherein:

(i) the packer disposed on the production string is a first packer;

(ii) the SIV sub-assembly is a first SIV sub-assembly;

(iii) the AL apparatus further comprises a second SIV subassembly integrally connected to a downhole end of the first SIV sub-assembly;

(iv) the first SIV sub-assembly is uphole of a second packer, wherein the second packer integral to the AL apparatus; and (v) the second SIV sub-assembly is downhole of the second packer.

9. The AL apparatus of claim 8, wherein the AL apparatus is configured such that the second packer can isolate an upper production zone proximate the first SIV sub-assembly from a lower production zone proximate the second SIV sub-assembly.

10. A method comprising:

attaching a packer and an artificial lift (AL) apparatus to a production tubing string configured to disposed within a wellbore drilled from a surface location drilled into a subterranean zone such that the packer is uphole of the AL apparatus, the AL apparatus comprising:

an electrical submersible pump (ESP) sub-assembly comprising:

an intake at a downhole end of the ESP sub-assembly:

a pump;

an ESP motor, the ESP motor configured to drive the pump;

a shut-in valve (SIV) sub-assembly at least partially enclosed within a cylindrical housing and integrally connected to a downhole end of the ESP sub-assembly, the SIV sub-assembly having one or more external ports and comprising:

a sliding sleeve;

a linear actuator connected to the sliding sleeve;

an electric valve motor operably attached to the linear actuator, the electric valve motor configured to drive the linear actuator to axially translate the sliding sleeve within the cylindrical housing; and a pressure sensor; and one or more electrical lines, wherein at least one of the one or more electrical lines extends from the surface location through the packer to the AL apparatus as an electrical line common to both the ESP motor and the electric valve motor to convey electrical current transmitted from the surface location to both the ESP motor and the electric valve motor;

disposing the production tubing string within the wellbore such that the SIV sub-assembly is proximate a production zone, thereby exposing the pressure sensor to fluid pressure in an annular volume within the wellbore exterior of the SIV sub-assembly downhole of the packer;

actuating the packer so as to isolate the annular volume;

transmitting, via the electrical line common to both the ESP motor and the electric valve motor, electrical current to the ESP, thereby activating the ESP motor to drive the pump to initiate a flow of fluid from the subterranean zone through the one or more external ports into the intake of the ESP sub-assembly and in an uphole direction through the production tubing string; and modulating a flow of fluid from the subterranean zone through one or more external ports of the SIV sub-assembly into the intake of the ESP sub-assembly by transmitting, via the electrical line common to both the ESP motor and the electric valve motor, electrical current to the electric valve motor.

11. The method of claim 10, further comprising receiving via the electrical line common to both the ESP motor and the electric valve motor, a signal comprising pressure sensor data from the pressure sensor.

12. The method of claim 10, wherein attaching the AL apparatus to the production tubing comprises attaching the AL apparatus to the production tubing as an integral unit.

13. The method of claim 10, wherein the electric control line is disposed through one penetration extending through a packing element of the packer.

14. The method of claim 13, wherein the modulating comprises blocking a subset of the plurality of ports by the sliding sleeve to modulate flow to a specified flow rate.

15. The method of claim 10, wherein the one or more external ports of the SIV sub-assembly comprise a plurality of external ports penetrating through and arrayed axially along the cylindrical housing, and the modulating is by the axial translation of the sliding sleeve blocking fluid flow through one or more of a plurality of external ports.

16. The method of claim 10, wherein:

the linear actuator comprises a screw having a screw axis, the screw attached to a nut attached to the sliding sleeve; and the screw axis of the screw is parallel to, and coincident with, a central axis of the cylindrical housing.

17. A system comprising:

a production string with a packer attached thereto and disposed within a wellbore drilled from a surface location into a subterranean zone;

an artificial lift (AL) apparatus attached as an integral unit to the production string downhole of the packer and comprising an electrical submersible pump (ESP) sub-assembly, a shut-in valve (SIV) subassembly, pressure sensor, and one or more electrical lines, wherein:

the ESP sub-assembly comprises:

an intake at a downhole end of the ESP sub-assembly:

a pump;

an ESP motor, the ESP motor configured to drive the pump and thereby pump fluids from the intake in an uphole direction through the production tubing string;

the SIV sub-assembly is at least partially enclosed within a cylindrical housing and comprises:

a sliding sleeve;

a linear actuator connected to the sliding sleeve;

an electric valve motor, the electric valve motor configured to drive the linear actuator to axially translate the sliding sleeve within the cylindrical housing, thereby modulating a flow of fluid from the subterranean zone through one or more external ports of the SIV sub-assembly into the intake of the ESP sub-assembly; and the pressure sensor is exposed to fluid pressure in an annular volume within the wellbore exterior of the SIV sub-assembly, wherein the system is configured such that (i) the ESP motor and the electric valve receive electrical current from at least one of the one or more electrical lines that extends from the surface location through the packer to the AL apparatus as an electrical line common to both the ESP motor and the electric valve and (ii) pressure data from the pressure sensor can be received at the surface location via the electrical line common to both the ESP motor and the electric valve.

18. The system of claim 17, wherein the one or more external ports of the SIV sub-assembly comprise a plurality of external ports penetrating through and arrayed axially along the cylindrical housing, and the modulating comprises modulating the flow of fluid comprises modulating the flow of fluid to a specified flow rate by axially translating the sliding sleeve to block a subset of the plurality of external ports.

19. The system of claim 17, wherein:

the linear actuator comprises a screw having a screw axis, the screw attached to a nut attached to the sliding sleeve; and the screw axis of the screw is parallel to, and coincident with, a central axis of the cylindrical housing.

20. The system of claim 17, wherein the packer disposed on the production string is a first packer and the SIV sub-assembly is a first SIV sub-assembly, and wherein the AL apparatus further comprises a second packer and a second SIV subassembly integrally connected to a downhole end of the first SIV sub-assembly such that the first SIV sub-assembly is uphole of the second packer and the second SIV sub-assembly is downhole of the second packer.

* * * * *